US006432899B1

(12) United States Patent
Sjostrom

(10) Patent No.: US 6,432,899 B1
(45) Date of Patent: Aug. 13, 2002

(54) COMPOSITION AND PROCESS FOR CLEANING AND DEOXIDIZING ALUMINUM

(75) Inventor: Terry D. Sjostrom, Kennesaw, GA (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/554,389

(22) PCT Filed: Nov. 12, 1998

(86) PCT No.: PCT/US98/23241

§ 371 (c)(1), (2), (4) Date: Jul. 13, 2000

(87) PCT Pub. No.: WO99/25798

PCT Pub. Date: May 27, 1999

Related U.S. Application Data

(60) Provisional application No. 60/065,246, filed on Nov. 13, 1997.

(51) Int. Cl.[7] ..... C11D 1/04; C11D 3/10; B08B 3/04

(52) U.S. Cl. ..... 510/245; 510/254; 510/255; 510/269; 510/271; 510/272; 134/3; 134/40

(58) Field of Search ..... 510/254, 255, 510/269, 271, 272; 134/3, 40, 41

(56) References Cited

U.S. PATENT DOCUMENTS 4,457,322 A * 7/1984 Rubin et al. ..... 134/2
4,886,616 A * 12/1989 Yamasoe et al. ..... 252/142
5,200,114 A * 4/1993 Beck ..... 252/542
5,634,979 A * 6/1997 Carlson et al. ..... 134/3

* cited by examiner

*Primary Examiner*—Gregory Delcotto
(74) *Attorney, Agent, or Firm*—Stephen D. Harper; Norvell E. Wisdom; Daniel S. Ortiz

(57) ABSTRACT

Cleaning and deoxidizing aluminum surfaces can be accomplished simultaneously by contacting the surfaces with an aqueous liquid composition that contains as its cleaning active ingredients (i) alcohols and/or ether alcohols, (ii) alkaline builders, and (iii) alkali stable surfactants, and, optionally but preferably, also contains fluoride and chelating agents.

19 Claims, No Drawings

COMPOSITION AND PROCESS FOR CLEANING AND DEOXIDIZING ALUMINUM

This application claims priority from provisional application No. 60/065,246, filed Nov. 13, 1997.

BACKGROUND OF THE INVENTION

The invention relates to a process for degreasing, cleaning, deoxidizing, etching and/or activating surfaces of solid objects that are constructed of and/or coated with metallic aluminum and/or aluminum alloys that contain at least 55 atomic percent of aluminum and that may be soiled with a wide variety of contaminants when the process is begun. Hereinafter, unless the context requires otherwise to be sensible or there is an express contrary indication, such as the use of the qualifier "pure" or the like, the term "aluminum" when used to describe a substrate being treated by or suitable to be treated by a process according to this invention is to be understood to include pure aluminum and all the alloys of aluminum that contain at least 55 atomic % of pure aluminum. Preferred aqueous compositions and processes of the invention provide satisfactory preparation of dean electrochemically active aluminum surfaces for use in subsequent surface finishing operations in the aerospace industry and in many other industrial uses of aluminum.

Aluminum articles in contact with the ambient natural atmosphere spontaneously develop surface layers, largely constituted of aluminum and oxygen atoms, that cause the aluminum surfaces to become electrochemically "passive", i.e., not to undergo at any readily appreciable rate many electrochemical reactions, such as the displacement plating of copper onto the aluminum surface when it is contacted with an aqueous liquid that contains copper cations in solution, that would be expected, from thermodynamic electrode potentials for metallic aluminum, to occur readily. Before many of the surface treatment processes desired to be used on aluminum articles can be effectively undertaken, much or all of this passivating layer must be removed from any aluminum surface that has it. Removing such layers is known in the art as a "deoxidizing" or "etching" process, these terms being intended to be interchangeable herein.[1]

[1]In principle, "etching" requires continuing appreciable dissolution of the surface being etched during prolonged exposure of the same aluminum surface to an etching process, while "deoxidizing" could occur without such continuing dissolution, by removing only the portions of the surface initially constituted of oxides and other non-elemental forms of the underlying metal, or by transforming these portions into elemental metal or alloy, without the necessity of dissolving any of the substrate that was originally in elemental form. In practice, however, no such "ideal" deoxidizing process has ever been developed, so that achieving deoxidizing also requires etching, and the two terms are usually used interchangeably.)

Also, many mechanical operations such as stamping, cutting, welding, grinding, drawing, machining, and polishing are used in the aluminum industry to provide shaped metal articles. In metal working operations, lubricants, antibinding agents, machining coolants and/or the like are normally utilized to prevent binding and sticking of the tools to the metal articles in the various metal working operations. The lubricants, coolants, and antibinding agents and/or the additives present in these compositions usually leave an oily, greasy, and/or waxy residue on the surface of the metal which has been worked. Any such residue initially present normally should be removed before a worked article is given a protective surface finish or incorporated into a finished assembly. Processes of this type are known as "degreasing" and/or "cleaning", with the latter of these terms being somewhat more general, because it requires removal of all contaminant materials, with a possible exception for tightly adhering conversion coatings such as the passivating oxide layers on aluminum.

At present, it is usually practically necessary to provide distinct types of treatment compositions and processing conditions to accomplish degreasing/cleaning and deoxidizing/etching. This necessity increases the cost of processing. Accordingly, a major object of this invention is to provide compositions and processes that will practically accomplish degreasing/cleaning and deoxidizing/etching simultaneously, a combination of utilities generally denoted hereinafter as "cleaning/deoxidizing", so that aluminum articles having greasy or otherwise soiled and at least partially passivated surfaces are made ready simultaneously for further surface treatment(s), usually including formation of a conversion coating, that enable the articles to meet the highly demanding standards of the aerospace industry, along with those of any or almost any other practical use of aluminum. Other objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of" and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that at least the major object of the invention as stated above can be achieved by use of a liquid working composition combining water and at least one of glycol, "polyglycol"[2], and glycol and polyglycol ether molecules as its two major constituents and also including alkalinizing agents and surfactant molecules, and, optionally and preferably, fluoride anions and/or chelating agents for multivalent metal cations (i.e., metal cations with at least two positive electric charges). More specifically, a working composition, i.e., a composition ready for use as such in cleaning/deoxidizing according to the invention, comprises, preferably consists essentially of, or more preferably consists of, water and the following dissolved components:

[2]As is generally known in the art, these are condensation polymers, in which one molecule of water has been eliminated for each except the first of the glycol "monomers" in the polymer, resulting in an ether oxygen bond between each two carbon chains characteristic of the glycol monomers from which the polyglycol is at least formally derived.

(A) a component of organic molecules of compounds that are liquid at 25° C. and are selected from the group consisting of: compounds made up of molecules that contain at least one, preferably at least two, hydroxyl oxygen atoms and otherwise contain only carbon and hydrogen and, optionally, halogen atoms, or preferably only carbon and hydrogen atoms; and compounds made up of molecules that contain at least one, or preferably at least two, ether oxygen atom(s) and otherwise contain only carbon, hydrogen, hydroxyl oxygen, and/or halogen atoms, or preferably only carbon and hydrogen atoms and, optionally, not more than one hydroxyl oxygen atom;

(B) a component of alkalinizing agent, often alternatively known in the detergent art as "builder", exclusive of any that contain fluoride anions; and (C) a component of alkali stable surfactant molecules that are not part of any of immediately previously recited components (A) and (B); and, optionally, one or more of the following components:

(D) a component of fluoride anions; and (E) a component of chelating agents that are not part of any of immediately previously recited components (A) through (D); and (F) a component of hydrotroping agent that is not part of any of immediately previously recited components (A) through (E).

In this description,"alkali stable" when referring to a surfactant means that the surfactant is capable of coexisting at its critical micelle concentration or at a concentration of 5% in an aqueous solution also containing at least, with increasing preference in the order given, 5, 10, 15, 20, 25, or 29% of sodium hydroxide, without any chemical reaction (except possibly for reversible neutralization) between the surfactant and the sodium hydroxide and without the formation of any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed.

In addition to the working compositions described above, embodiments of the invention include: concentrate compositions suitable for preparing working compositions by mixing the concentrate composition with water and, optionally, other concentrate compositions; replenisher compositions, suitable for maintaining the cleaning/deoxidizing effectiveness of a selected quantity of a working composition according to the invention by restoring to it any ingredients of the selected quantity of working composition that are removed from the quantity of working composition during its use and are needed to maintain its effectiveness; and process embodiments, which include at a minimum contacting an aluminum article substrate with a working composition according to the invention to remove any soils initially present on the substrate and produce a surface that is free from any water breaks when contacted with pure liquid water and that will spontaneously plate itself with copper within a time of ten minutes from its immersion at 25° C. in an aqueous solution of copper(II) sulfate containing at least 1% of copper(II) cations, and may include other process steps, particularly those which are conventional in themselves preceding or following etching/deoxidizing and/or cleaning/degreasing aluminum surfaces in the prior art.

In addition to the above noted necessary and optional materials, compositions of the present invention can additionally contain germicides, preserving agents and the like, and they can, and after a period of use usually do, contain very substantial amounts of dissolved aluminum, mostly in the form of aluminate anions. A composition of the present invention does not generally require the presence of a foam suppressing agent. The inclusion of foam suppressing agents, however, is also within the broad scope of the invention.

DETAILED DESCRIPTION OF THE INVENTION

Working compositions and processes according to this invention are effective over a wide range of pH values. For primary degreasing/deoxidizing prior to most subsequent operations, an alkaline working composition according to the invention is preferred because it generally effects adequate degreasing more rapidly. The particular degree of alkalinity that is most preferred generally requires a compromise between quick degreasing, which is favored by greater alkalinity, and avoiding excessive corrosion, which is favored by lower alkalinity. The alkalinity is conveniently measured for preparation of a working composition according to the invention and for replenishment during use of such a composition by a value denoted as "free caustic" with units of grams per liter, hereinafter usually abbreviated as "g/l", and measured by the following test:

A sample of the liquid composition in which there is dissolved aluminum and in which free caustic is to be measured is filtered, using a Buchner funnel, vacuum filtration flask, and Whatman #50 hardened filter paper. A 10.0 milliliter (hereinafter usually abbreviated as "ml") aliquot of the filtered composition, about 30 ml of hot distilled, deionized, or similarly pure water (hereinafter usually abbreviated as "DI water"), and about 10 ml of a solution of barium chloride in water that contains 100 g/l of $BaCl_2$ are mixed in succession in a container such as a beaker, causing precipitation of any non-hydroxide alkalinizing agent content of the liquid composition as barium salt(s). The mixture of liquid and precipitate is filtered, using the same type of filtration equipment as before except that a glass fiber filter having a pore size of 1.2 micrometres (hereinafter usually abbreviated as "$\mu$m") is used instead of filter paper. The container is rinsed twice with a volume of 30 to 50 ml of DI water each time, with the rinse water being filtered through the same filter as, and collected with the filtrate from, the first filtration after addition of the $BaCl_2$ solution.

The remnant water in the container is then tested with pH paper, which should indicate a neutral pH; if it does not, additional rinsing with DI water should be continued until the remnant water does have a neutral pH, using as small a volume of additional rinse water as possible to accomplish this purpose.

After all rinsing is completed, the filtration should be continued until the filtered precipitate is dry and no further drops of liquid are observed to pass through the funnel. The filtrate liquid is then titrated with 1.00 N HCl solution to a white turbid endpoint (precipitation of hydrous aluminum oxide as the pH of the liquid phase falls). The value of free caustic in g/l is 5.6 times the number of ml of 1.00 N acid solution consumed in the titration.

If it is also desired to determine the dissolved aluminum content in the original composition, 4 drops of phenolphthalein indicator solution are added to the titration mixture at this point, and the titration is continued until the pink color disappears. The number of additional ml of 1.00 N acid required to reach this second end point, multiplied by 2.67, yields the value of g/l of dissolved aluminum in the original composition.

If the composition does not contain aluminum, the free caustic is determined in the same way, except that phenolphthalein indicator solution is added to the filtrate immediately, and the titration is to disappearance of the pink color; no precipitate should form during this titration.

For these aerospace industry applications of the invention when rapid cleaning/deoxidizing is desired, specifically when a layer 5 $\mu$m deep inward from the surface must be removed from the substrate during not more than 15 minutes of contact time between the substrate surface and the cleaning/deoxidizing liquid composition, but the total depth of material removed during a complete cleaning/deoxidizing process on a given substrate article may not exceed 5 Mm, the free caustic value of a working composition according to the invention preferably is at least, with increasing preference in the order given, 2, 4, 6, 8, 10, 12, or 14 g/l and independently preferably is, with increasing preference in the order given, not more than 120, 100, 80, or 60 g/l and, unless exceptionally fast etch rates are desired, more preferably is not more than, with increasing preference in the order given, 55, 50, 45, 40, 35, or 30 g/l. Lower values within these preferences are normally preferred when the content of dissolved aluminum in the composition is relatively low and higher values are normally preferred when the content of dissolved aluminum in the composition is relatively high, in order to maintain a constant etch rate as part of a cleaning/deoxidizing process according to the invention.

Component (A) is preferably selected from molecules each of which contains at least two ether oxygen atoms and one hydroxyl oxygen atom and otherwise contains only carbon and hydrogen atoms, and, optionally, halogen atoms; more preferably, primarily for reasons of economy, these molecules contain no halogen atoms. Independently, component (A) is preferably selected from molecules each of which contains at least, with increasing preference in the order given, 2, 4, 6, or 8 carbon atoms and independently preferably contains not more than, with increasing preference in the order given, 18, 16, 14, or 10 carbon atoms. Independently of all other preferences, component (A) further is selected from substances that are sufficiently soluble in water to form a solution containing at least, with increasing preference in the order given, 2, 5, 10, 12, 15, 18, or 20% of the substance(s) selected for component (A). The single most preferred material for component (A) is one generally known as "diethylene glycol monobutyl ether", which has the chemical formula $HO—C_2H_4—O—C_2H_4—O—C_4H_9$. Independently of its exact chemical constitution, component (A) in a working composition according to the invention preferably is present in a concentration of at least, with increasing preference in the order given, 2, 5, 10, 12, 15, 17, 18.0, 19.0, 19.5, or 19.9% and independently preferably, primarily for reasons of economy, is not more than, with increasing preference in the order given, 75, 50, 40, 35, 30, 27, 25, 23, or 21%.

Alkalinizing component (B) is preferably selected from various inorganic salts and hydroxides known to be useful as "inorganic builders" in cleaning formulations generally. Inorganic builders, except for hydroxides, are generally salts of polyfunctional inorganic acids, such as alkali metal silicates, alkali metal borates, alkali metal carbonates, alkali metal sulfates, alkali metal polyphosphates, alkali metal phosphates, alkali metal orthophosphates, and alkali metal pyrophosphates. Salts such as sodium silicate, sodium metasilicate, sodium orthosilicate, sodium tetraborate, sodium borate, sodium sulfate, sodium carbonate, trisodium phosphate, disodium orthophosphate, sodium metaphosphate, sodium pyrophosphate, the corresponding potassium salts to all of these, sodium and potassium hydroxides, and the like are all suitable alkalinizing agents for compositions according to the present invention. Lithium, rubidium, and cesium salts and hydroxides are also suitable, although usually less preferred because of their higher cost, and ammonium salts are technically suitable but are generally avoided because of the chance of loss by volatilization and the accompanying odor nuisance of ammonia fumes. Because of higher solubility, potassium cations are preferred over sodium cations in most instances in constituents of alkalinizing component (B), despite their slightly higher cost.

More preferably, in a composition according to this invention, an alkali metal hydroxide and an alkali metal salt of a polyfunctional inorganic acid are both part of component (B). More particularly, a freshly prepared working composition according to the invention, free of dissolved aluminum, preferably contains hydroxide ions in a concentration that is at least, with increasing preference in the order given, 0.05, 0.10, 0.15, 0.20, 0.25, 0.30, 0.35, 0.40, or 0.43% of the total composition and independently preferably is not more than, with increasing preference in the order given, 3.0, 2.5, 2.0, 1.5, 1.0, 0.80, 0.70, 0.65, 0.60, 0.55, 0.50, or 0.45% of the total composition. (The concentrations specified as preferable in this paragraph are to be understood to include the entire stoichiometric equivalent as $OH^-$ of all soluble hydroxides added in the course of preparation of a composition according to the invention, unless some of this content has been removed by physical means.)

The free caustic value determined as described above is the strongest compositional influence on the etch rate obtained with a composition according to the invention, the etch rate increasing with increasing free caustic value. The free caustic value in a freshly prepared preferred composition according to the invention is nearly equivalent to the concentration, expressed in g/l, of the stoichiometric equivalent as KOH of the hydroxide ion concentration in the same composition, but as the composition is used, much of its originally added hydroxide ions content is converted to aluminate anions, which do not contribute any substantial amount to the free caustic value.

Independently, a composition according to the invention that contains both hydroxide and non-hydroxide materials for component (B) preferably contains the nonhydroxide materials, which are independently preferably selected from the group consisting of fully neutralized salts of polyfunctional inorganic acids, in a concentration that is at least, with increasing preference in the order given, 0.010, 0.020, 0.030, 0.040, 0.050, 0.055, 0.060, 0.065, or 0.070 moles of non-hydroxide alkalinizing agents per kilogram of total composition, this concentration unit being freely applied hereinafter to any other solute as well as to non-hydroxide alkalinizing agents and being hereinafter usually abbreviated as "M/kg". The concentration of non-hydroxide alkalinizing agents independently preferably is not more than, with increasing preference in the order given, 0.50, 0.40, 0.30, 0.20, 0.17, 0.14, 0.12, 0.10, or 0.08 M/kg. Carbonates are the single most preferred non-hydroxide alkalinizing agents in a composition according to the invention, inasmuch as they normally can be replenished, to the slight extent that their replenishment is needed, by absorption of carbon dioxide from the natural ambient atmosphere.

Component (C) preferably contains two subcomponents. Preferred subcomponent (C.1) is selected from the group consisting of Alkali Surfactant JEN 2700™, commercially supplied by Tomah Chemical Products, Milton, Wisconsin and reported by its supplier to be a solution in water of about 35% of its surfactant ingredient, monosodium salt of isodecyloxypropylaminodipropionic acid, an amphoteric surfactant, and SURMAX™ CS504, -515, -521, -522, -555, -586, -634, -684, -727, -772, and -786 surfactans, all commercially available from Chemax, Inc., Greenville, S.C. and reported by their supplier to be amphoteric-anionic alkali stable surfactants that include organic esters, and/or salts of organic esters, of phosphoric acid, with other compositional information being proprietary. The concentration of subcomponent (C.1) in a composition according to the invention preferably is at least, with increasing preference in the order given, 0.02, 0.04, 0.08, 0.10, 0.12, 0.14, 0.16, 0.18, or 0.20% of the total composition and independently preferably is not more than, with increasing preference in the order given, 1.0, 0.90, 0.80, 0.70, 0.60, 0.50, 0.40, 0.35, 0.30, or 0.25% of the total composition.

Preferred subcomponent (C.2) is selected from the group consisting of ethoxylates of alkyl phenols, more preferably octyl and nonyl phenols, these ethoxylates independently preferably having a hydrophile-lipophile balance (hereinafter usually abbreviated as "HLB") value that is at least, with increasing preference in the order given, 9.0, 10.0, 11.0, 12.0, 12.5, 13.0, or 13.4 and independently preferably is not more than, with increasing preference in the order given, 16.0, 15.0, 14.5, 14.1, 13.8, or 13.6. Independently, the concentration of subcomponent (C.2) in a composition according to the invention preferably is at least, with increasing preference in the order given, 0.05, 0.10, 0.20, 0.25, 0.30, 0.35, 0.40, 0.45, or 0.48% of the total composition and independently preferably is not more than, with increasing preference in the order given, 3.0, 2.5, 2.0, 1.5, 1.2, 0.90, 0.70, 0.60, or 0.52% of the total composition.

When subcomponents (C.1) and (C.2) as defined above are both present in a composition according to the invention, the ratio of the concentrations, expressed in the same units, of subcomponents (C.1) and (C.2) in the composition preferably is at least, with increasing preference in the order given, 0.10:1.0, 0.15:1.0, 0.20:1.0, 0.25:1.0, 0.30:1.0, 0.35:1.0, or 0.40:1.0 and independently preferably is not more than, with increasing preference in the order given, 1.0:1.0, 0.80:1.0, 0.70:1.0, 0.60:1.0, 0.55:1.0, or 0.50:1.0.

The presence of optional component (D) of fluoride anions in a working composition according to the invention is normally preferred, because it favors a uniform surface appearance at the completion of a cleaning/deoxidizing process according to the invention. However, if this is not important in a particular application, component (D) may be omitted. Fluoride ions may be provided to a composition according to the invention by any of the sufficiently water soluble salts and acids that contain either simple or complex fluoride anions and when thus supplied are presumed, for purposes of calculations of fluoride anions content of the composition, to be present to the full stoichiometric extent of fluorine-atom-containing anions in the materials dissolved in the composition, irrespective of the actual extent of ionization that may exist in the composition. Primarily for reasons of economy, sources of simple fluoride anions are generally preferred, and because of the high alkalinity preferred for the composition as a whole, salts are preferred over acids as the source of the fluoride anions. The same counterions in these salts as described above for the alkalinizing component (B) are preferred for component (D) for the same reasons. Potassium fluoride is the single most preferred source for component (D).

In a freshly prepared or otherwise dissolved-aluminum-free working composition according to the invention, the concentration of fluorine in the form of fluoride anions preferably is at least 0.02, 0.04, 0.06, 0.08, 0.10, 0.12, 0.14, or 0.16 parts per thousand parts of the total composition, a unit of concentration that may be freely applied herein-after to any other constituent of the composition as well as to fluorine and is usually abbreviated as "ppt", and independently preferably is not more than 1.0, 0.80, 0.60, 0.40, 0.35, 0.30, 0.25, or 0.20 ppt.

Because fluoride anions are at least moderately effective complexing agents for aluminum(III) cations, converting them partially to hexafluoroaluminate(III) anions, after composition according to the invention has been in use or for some other reason contains a substantial amount of dissolved aluminum, the fluoride content of the composition is preferably controlled by a measurement called "free fluoride" rather than by the total fluorine content of the composition. "Free fluoride" is measured by use of an ionspecific electrode and associated equipment known to those skilled in the art. The free fluoride value of a freshly prepared composition according to the invention preferably should be measured and used as a target for fluoride additions, when such additions are needed as the composition is used, to restore the original free fluoride value for the freshly prepared composition.

Optional chelating agent component (E) is usually preferred in most compositions according to the invention. Any material recognized in the art as a chelating agent for aluminum, calcium, and/or magnesium cations in aqueous solution may be used. The exact function of the chelating agent is not known, but it has at least two potentially valuable functions: As a chelating agent for aluminum, it can promote the etching rate of a composition containing it, and as a chelating agent for calcium and magnesium, it can make the use of tap water instead of DI water satisfactory in some instances.

Preferred chelating agents include sufficiently water-soluble organic compounds, and the metal salts of such of these compounds as are organic acids, that contain at least two —OH moieties (which may or may not be part of carboxyl moieties) positioned within the molecules of the compounds in such a way that the two oxygen atoms are separated from each other by at least two carbon atoms. Examples of such organic compounds include nitrilotriacetic acid ("NTA"), ethylene diamine tetraacetic acid ("EDTA"), citric, tartaric, malic and gluconic acids and their salts, and saccharides (sugars), with the latter preferred and sorbitol particularly preferred. Independently of its exact chemical constitution, the concentration of the chelating agent component in a working composition according to the invention preferably is at least, with increasing preference in the order given, 0.02, 0.04, 0.06, 0.08, 0.10, 0.12, or 0.14% of the total composition and independently preferably is not more than, with increasing preference in the order given, 1.0, 0.8, 0.6, 0.40, 0.35, 0.30, 0.25, 0.20, or 0.15% of the total composition.

Optional hydrotroping component (F) is not generally needed in most working compositions according to this invention, in part because many of the preferred constituents of component (C) have some hydrotroping effect, but is useful in a preferred replenisher composition as noted further below. Conventional hydrotroping agents such as the salts of alkyl benzene sulfonic acids, particularly of cumene sulfonic acid, are suitable for compositions to accomplish the cleaning purposes of this invention, but may interfere with the later intended use of the substrates to be cleaned, because very low tolerances for residual sulfur on the surface are specified for many aerospace applications. Other types of hydrotropes are therefore preferred, when an additional hydrotrope is needed, for most formulations according to this invention. Organic phosphate esters and alkyl and alkenyl substituted cyclic acid anhydrides, particularly the anhydrides of $C_{4-6}$ terminal dicarboxylic acids substituted with alkyl or alkenyl groups having 6 to 20 carbon atoms are both useful. A particularly preferred example of this type of hydrotrope is nonenyl succinic anhydride. These two types are even more preferred in combination with each other, in a ratio of phosphate esters to substituted cyclic anhydrides that preferably is, with increasing preference in the order given, at least 0.1, 0.2, 0.4, 0.6, 0.80, 0.90, 1.00, 1.10, 1.20, 1.30, 1.40, 1.50, or 1.55 and independently preferably is, with increasing preference in the order given, not more than 20, 15, 10, 7, 5, 4, 3, 2.7, 2.4, 2.2, 2.0, 1.9, 1.8, 1.75, 1.70, or 1.65. A particular commercial hydrotroping agent, AMPHOTERIC SC from Tomah Products, Inc., with a chemical constitution unknown to the applicant except that its active ingredients are "based on alkyliminodipropionates" and constitute 35% of the total composition as commercially supplied (the balance presumably being water) has also been found to be effective and is most preferred. The amount of hydrotroping agent is not believed to be critical, but should be sufficient to accomplish its purpose and, for reasons of economy, preferably is little or no more than this sufficient value. As a general guide, the amount of hydrotroping agent in a principal replenisher composition according to the invention that includes at least 7% of potassium hydroxide and at least 0.1% of nonionic surfactants preferably is at least, with increasing preference in the order given, 0.1, 0.3, 0.5, 0.7, or 0.9% and independently preferably is not more than, with increasing preference in the order given, 11, 7, 5, 3, 2.0, or 1.1%.

As would be expected in view of some of the discussion above, the ingredients of a composition according to the invention are not depleted during use in the same proportions as they are present in a preferred freshly made working composition according to the invention. It has been found that two replenishers are preferred, one containing only fluoride anions and their counterions as active ingredients, and another that contains all of the other ingredients of a preferred working composition according to the invention, except the non-hydroxide alkalinizing agent if the latter is a carbonate salt as is most preferred, plus a hydrotroping agent, but with considerably greater concentrations of component (B) and smaller concentrations of the other necessary components and of the optional but preferred chelating agents. More particularly, a principal replenisher composition according to the invention is a liquid that in addition to water preferably comprises, more preferably consists essentially of, or still more preferably consists of the following concentrations of the components already defined by letter identifiers for working compositions:

component (A) preferably is present in a concentration of at least, with increasing preference in the order given, 0.44, 1.1, 2.2, 2.6, 3.3, 3.7, 4.0, 4.10, 4.20, or 4.30% and independently preferably, primarily for reasons of economy, is not more than, with increasing preference in the order given, 17, 11, 8.8, 7.7, 6.6, 6.0, 5.5, 5.0, or 4.5%;

hydroxide ions are preferably present in a concentration that is at least, with increasing preference in the order given, 0.5, 1.0, 1.5, 2.0, 2.5, 3.0, 3.5, 4.0, or 4.3% of the total composition and independently preferably is not more than, with increasing preference in the order given, 30, 25, 20, 15, 10, 8.0, 7.0, 6.5, 6.0, 5.5, 5.0, or 4.5% of the total composition;

subcomponent (C.1) is preferably present in a concentration that is at least, with increasing preference in the order given, 0.05, 0.009, 0.019, 0.023, 0.030, 0.033, 0.037, 0.042, or 0.047% of the total composition and independently preferably is not more than, with increasing preference in the order given, 0.23, 0.21, 0.19, 0.16, 0.14, 0.12, 0.093, 0.081, 0.069, or 0.058% of the total composition;

subcomponent (C.2) is preferably present in a concentration that is at least, with increasing preference in the order given, 0.02, 0.04, 0.07, 0.090, 0.095, 0.100, 0.105, or 0.110% of the total composition and independently preferably is not more than, with increasing preference in the order given, 1.1, 0.9, 0.7, 0.50, 0.35, 0.23, 0.18, 0.14, or 0.12% of the total composition;

a chelating agent component is preferably present in a concentration that preferably is at least, with increasing preference in the order given, 0.004, 0.008, 0.012, 0.016, 0.020, 0.024, or 0.028% of the total composition and independently preferably is not more than, with increasing preference in the order given, 0.20, 0.16, 0.12, 0.080, 0.070, 0.060, 0.050, 0.040, or 0.030% of the total composition.

Solid powdered potassium fluoride is effective and inexpensive and is therefore generally most preferred as the supplemental fluoride replenisher, but if a liquid replenisher should be preferred, for example because of better adaptability to automated replenishment in response to signals from a free fluoride sensing electrode, a solution in water of any of the suitable sources of fluoride can be used.

Aluminum articles to be cleaned/deoxidized should be contacted with an aqueous liquid cleaning/deoxidizing composition according to the present invention at a sufficient temperature for a sufficient time to be effective for cleaning/deoxidizing. Normally, the temperature of a working composition according to the invention during its actual use preferably is at least 32° C. Higher etching rates will be achieved at higher temperatures, as illustrated in the examples below, and a temperature of at least 55° C. can be satisfactorily used if a high etch rate is desired. Times of contact between the cleaning/deoxidizing composition and the substrate to be cleaned/deoxidized in a process according to the invention normally are preferably between 1 and 15 min.

The invention is particularly advantageously applied to aluminum substrates that contain at least, with increasing preference in the order given, 65, 75, 85, or 90 atomic percent of pure aluminum.

The following examples illustrate the compositions and methods of the present invention. The examples are for illustrative purposes only and are not intended to limit the invention.

WORKING COMPOSITION AND PROCESS EXAMPLES

The ingredients and amounts of each ingredient used in two working compositions according to the invention are shown in Table 1 below. Both of these compositions are tested for cleaning/deoxidizing at least one of Types AA2024, AA6061, and AA7075 aluminum substrates at several different temperatures, and for each composition at each temperature, a substantially linear correlation between exposure time and thickness of material removed during contact times up to 20 min is achieved and designated the "etch rate". These etch rates are shown in Table 2 below.

A principal replenisher suitable for use in replenishing either Composition 1 or Composition 2 has the composition shown in Table 3 below.

VARIATION OF ETCH RATE WITH DISSOLVED ALUMINUM CONCENTRATION

The etch rate values given in Table 2 are for solutions that contain no dissolved aluminum at the beginning of their use. When Composition 1 as shown in Table 1 has accumulated about 39 g/l of dissolved aluminum, its initial free caustic value has been restored by additions as needed of the principal replenisher composition shown in Table 3, and its free fluoride concentration has been restored if needed by addition of potassium fluoride, the etch rate at 54° C. is about 98% of its value when the composition was freshly made. Under the same conditions, when the accumulated dissolved aluminum concentration reaches about 42 g/l, the etch rate is only about 93% of its initial value, and when dissolved aluminum reaches a concentration of about 53 g/l, the etch rate is only about 88% of its original value. If desired, the original rates can be restored by increasing the free caustic value of the composition.

TABLE 1

EXAMPLE WORKING COMPOSITIONS ACCORDING TO THE INVENTION

| Ingredient | Concentration of Ingredient as a % of the Total Composition for Composition Number: 1 | 2 |
|---|---|---|
| Diethylene glycol monobutyl ether | 20 | 20 |
| Potassium hydroxide | 1.4 | 2.8 |
| Potassium carbonate | 1.0 | 1.0 |
| SURMAX ™ CS-555 surfactant | 0.30 | 0.30 |
| TRITON ™ X-100 surfactant | 0.50 | 0.50 |
| Potassium fluoride | 0.50 | 0.50 |
| Solution of 70% sorbitol in water | 0.20 | 0.20 |
| Deionized Water | Balance in both compositions | |

Note for Table 1
TRITON ™ X-100 was commercially supplied by Union Carbide Corp. and is reported by its supplier to be a 100 % active mixture of octylphenol poly(ethoxy) ethanol molecules with an HLB value of 13.5.

TABLE 2

ETCH RATES AT VARIOUS TEMPERATURES

| Working Composition Number | Etch Rate in Micrometres per Minute at a Temperature of: 26.7° C. | 32.2° C. | 37.7° C. | 43.5° C. | 54.4° C. |
|---|---|---|---|---|---|
| 1 | 0.31 | 0.47 | 0.82 | 1.48 | 3.22 |
| 2 | 0.52 | 0.74 | 1.14 | 1.90 | 4.00 |

Note for Table 2
The working composition numbers are those from Table 1

TABLE 3

EXAMPLE PRINCIPAL REPLENISHER COMPOSITION ACCORDING TO THE INVENTION

| Ingredient | Concentration of Ingredient as a % of the Total Composition in a Preferred Principal Replenisher Composition |
|---|---|
| Diethylene glycol monobutyl ether | 4.40 |
| Potassium hydroxide | 14.4 |
| SURMAX ™ CS-555 surfactant | 0.07 |
| TRITON ™ X-100 surfactant | 0.11 |
| Solution of 70% sorbitol in water | 0.20 |
| AMPHOTERIC SC | 3.2 |
| Deionized Water | Balance of the composition |

What is claimed is:

1. An aqueous liquid composition of matter, for cleaning/deoxidizing aluminum surfaces, said composition comprising water and the following dissolved components:

(A) a component of organic molecules of compounds that are liquid at 25° C. and are selected from the group consisting of: compounds made up of molecules that contain at least one hydroxyl oxygen atom and otherwise contain only carbon and hydrogen; and compounds made up of molecules that contain at least one ether oxygen atom and otherwise contain no atoms other than carbon, hydrogen, ether oxygen, hydroxyl oxygen, and halogen atoms;

(B) a component of alkalinizing agent, exclusive of any that contain fluoride anions;

(C) a component of alkali stable surfactant molecules that are not part of any of immediately previously recited components (A) and (B); and (D) a component of fluoride anions.

2. The aqueous liquid composition of claim 1 wherein:

component (A) is selected from molecules each of which contains at least two ether oxygen atoms and one hydroxyl oxygen atom, otherwise contains only carbon and hydrogen atoms and contains from 2 to 18 carbon atoms; further wherein component (A) is selected from substances that are sufficiently soluble in water to form a solution containing at least 2% of the substance(s) selected for component (A); and the amount of component (A) is from about 2% to about 75% based on the total weight of the aqueous liquid composition.

3. The aqueous liquid composition of claim 1 wherein:

component (B) is selected from the group consisting of alkali metal hydroxides, alkali metal silicates, alkali metal borates, alkali metal carbonates, alkali metal sulfates, alkali metal polyphosphates, alkali metal phosphates, alkali metal orthophosphates, and alkali metal pyrophosphates, and combinations thereof; and component (B) comprises an amount of alkali metal hydroxide that is from about 0.05% to about 3.0% of the total composition and an amount of one or more alkali metal salts of polyfunctional inorganic acids that is from about 0.010 to about 0.50 moles per kilogram of the total aqueous liquid composition.

4. The aqueous liquid composition of claim 1 wherein the alkalinizing agent comprises a carbonate.

5. The aqueous liquid composition of claim 1 wherein component (C) comprises:

from about 0.02% to about 1.0% of a subcomponent (C.1) selected from the group consisting of monosodium salt of iso-decyloxypropylaminodipropionic acid, organic esters of phosphoric acid, and salts of organic esters of phosphoric acid; and from 0.05 to about 3.0% of a subcomponent (C.2) selected from the group consisting of ethoxylates of alkyl phenol component (C.2) having a hydrophile-lipophile balance value from about 9.0 to about 16.0.

the ratio of the amount of subcomponent (C.1) to the amount of subcomponent (C.2) being from about 0.10:1.0 to about 1.0:1.0.

6. The aqueous liquid composition of claim 1 further comprising from about 0.02 to about 1.0 parts of fluoride anions per thousand parts of the total composition.

7. The aqueous liquid composition of claim 1 further comprising a chelating agent that is not part of any of components (A) through (D).

8. The aqueous liquid composition of claim 1 further comprising a hydrotroping compound.

9. The aqueous liquid composition of claim 1, said composition consisting essentially of water and the following dissolved components:

from about 17 to about 25% of diethylene glycol monobutyl ether, based on the total weight of the aqueous liquid composition;

an amount of potassium hydroxide that corresponds stoichiometrically to a concentration of from about 0.35 to about 0.55%, based on the total weight of the aqueous liquid composition;

from about 0.060 to about 0.10 moles of potassium carbonate per kilogram of the aqueous liquid composition;

from about 0.16 to about 0.35%, based on the total composition, of surfactant selected from the group consisting of monosodium salt of iso-decyloxypropylaminodipropionic acid, organic esters of phosphoric acid, and salts of organic esters of phosphoric acid and mixtures thereof;

from about 0.40 to about 0.60%, based on the total composition, of surfactant selected from the group consisting of octyl- and nonyl-phenol poly(ethoxy) ethanol molecules, said last recited surfactant as a whole having an HLB value that is from about 12.0 to about 15.0;

an amount of potassium fluoride that imparts to the total composition a free fluoride value possessed by a reference total composition that contains no dissolved aluminum cations but otherwise contains from about 0.12 to about 0.30 ppt of dissolved fluoride anions, together with all other ingredients of the actual total composition; and from about 0.10 to about 0.40% of sorbitol, based on the total weight of the aqueous liquid composition.

10. An aqueous liquid composition of matter, for cleaning/deoxidizing aluminum surfaces, said composition having been made by mixing with a first mass of water at least the following masses, which dissolve in said first mass of water when mixed therewith:

(A) a second mass of molecules selected from the group consisting of organic molecules of compounds that are liquid at 25° C., which molecules further either:

(i) contain at least one hydroxyl oxygen atom and otherwise contain only carbon and hydrogen atoms or (ii) contain at lest one ether oxygen and otherwise contain no atoms other than carbon, hydrogen, hydroxyl oxygen, ether oxygen, and halogen atoms;

(B) a third mass of alkalinizing agent, exclusive of any that contain fluoride anions;

(C) a fourth mass of alkali stable surfactant molecules that are not part of any of immediately previously recited components (A) and (B); and (D) a fifth mass of fluoride anions.

11. The aqueous liquid composition of claim 10, wherein said second mass constitutes at least about 5% of the total aqueous liquid composition and said third mass includes hydroxyl ions that constitute at least about 0.10% of the total aqueous liquid composition.

12. The aqueous liquid composition of claim 11, wherein;

mass (A) is selected from molecules each of which contains at least two ether oxygen atoms and one hydroxyl oxygen atom and otherwise contains no atoms except carbon, halogen, and hydrogen atoms, said last recited molecules each including at least 2 carbon atoms and not more than 18 carbon atoms;

mass (B) is selected from the group consisting of alkali metal hydroxides, alkali metal silicates, alkali metal borates, alkali metal carbonates, alkali metal sulfates, alkali metal polyphosphates, alkali metal phosphates, alkali metal orthophosphates, and alkali metal pyrophosphates;

mass (C) includes a submass (C.1) selected from the group consisting of monosodium salt of iso-decyloxypropylaminodipropionic acid, organic esters of phosphoric acid, salts of organic esters of phosphoric acid, and mixtures thereof and a distinct submass (C.2) selected from the group consisting of ethoxylates of alkyl phenols, submass (C.1) constituting at least about 0.04% of the total composition, submass (C.2) constituting at least about 0.10% of the total composition, and submass (C.1) having a ratio to submass (C.2) that is from 0.20:1.0 to 0.80:1.0;

there is also mixed to make the aqueous liquid composition a fifth mass (D) of fluoride anions that imparts to the total composition a free fluoride value possessed by a reference total composition that contains no dissolved aluminum cations but otherwise contains from about 0.04 to about 0.60 ppt of dissolved fluoride anions, together with all other ingredients of the actual total composition; and there is further mixed to make the aqueous liquid composition a sixth mass of chelating agent selected from the group consisting of nitrilotriacetic acid, ethylenediamine tetraacetic acid, citric acid, tartaric acid, malic acid, gluconic acid, salts of all of the immediately previously recited acids, and saccharides, said sixth mass constituting from about 0.04 to about 0.6% by weight of the total aqueous liquid composition.

13. The aqueous liquid composition of claim 12, wherein:

mass (A) is selected from molecules that contain no halogen atoms and from 4 to 14 carbon atoms;

mass (B) includes a submass (B.1) of alkali metal hydroxide(s) that contain hydroxide ions that constitute from about 0.25 to about 0.70% of the total composition and a submass (B.2) selected from the group consisting of alkali silicates, alkali metal borates, alkali metal carbonates, alkali metal sulfates, alkali metal polyphosphates, alkali metal phosphates, alkali metal orthophosphates, and alkali metal pyrophosphates, all fully neutralized, said submass (B.2) containing a number of moles that corresponds to from about 0.020 to about 0.20 moles per kilogram of the total composition;

submass (C.1) constitutes from about 0.08 to about 0.60% of the total composition, submass (C.2) constitutes from about 0.25 to about 1.5% of the total composition, and submass (C.1) has a ratio to submass (C.2) that is from 0.25:1.0 to 0.60:1.0.

14. The aqueous liquid composition of claim 13, wherein there has been mixed with said first water to make said aqueous liquid composition:

a second mass of diethylene glycol monobutyl ether that constitutes from about 17 to about 25% of the total mass of the aqueous liquid composition;

a submass (B.1) of potassium hydroxide that corresponds stoichiometrically to a concentration of hydroxide ions that is from about 0.35 to about 0.55%, based on the total mass of the aqueous liquid composition;

a submass (B.2) of potassium carbonate that constitutes from about 0.060 to about 0.10 moles of potassium carbonate per kilogram of the aqueous liquid composition;

a submass (C.1) that constitutes from about 0.16 to about 0.35%, based on the total composition;

a submass (C.2) that constitutes from about 0.40 to about 0.60% of the total mass of the aqueous liquid composition and is selected from the group consisting of octyl- and nonyl-phenol poly(ethoxy) ethanol molecules, said submass (C.2) as a whole having an HLB value that is from about 12.0 to about 15.0;

an amount of potassium fluoride that imparts to the total composition a free fluoride value possessed by the reference total composition when it contains from about 0.12 to about 0.30 ppt of dissolved fluoride anions; and a mass of sorbitol that constitutes from about 0.10 to about 0.40% of the total composition.

15. A method for cleaning/deoxidizing an aluminum substrate, said method comprising an operation of contacting the substrate with an aqueous liquid cleaning/deoxidizing composition according to claim 1 at a sufficient temperature for a sufficient time to be effective for cleaning/deoxidizing.

16. An aqueous liquid concentrate composition of matter, for replenishing liquid compositions or used for cleaning/deoxidizing aluminum surfaces, said concentrate composition comprising water and the following dissolved components:

from about 0.44% to about 17%, based on the total weight of the aqueous liquid concentrate composition, of a component of organic molecules of compounds that are liquid at 25° C., said molecules containing either: (i) at least one hydroxyl oxygen atom and otherwise only carbon and hydrogen atoms or (ii) at lease one ether oxygen atom and otherwise no atoms other than carbon, hydrogen, hydroxyl oxygen, and halogen atoms;

a component of alkalinizing agent that includes hydroxide ions in an amount sufficient to constitute from about 0.05% to about 30.0% of the total composition;

from about 0.005 to about 0.23% of alkali stable surfactant selected from the group consisting of monosodium salt of iso-decyloxypropylaminodipropionic acid, organic esters of phosphoric acid, salts of organic esters of phosphoric acid and mixtures thereof;

from about 0.02 to about 1.1% of alkali stable surfactant selected from the group consisting of ethoxylates of alkyl phenol; and from about 0.004 to about 0.20% of chelating agent selected from the group consisting of water-soluble organic compounds that contain at least two —OH moieties positioned within the molecule of the compound so that the two oxygen atoms of the two —OH moieties are separated from each other by at last two carbon atoms.

17. A method for cleaning/deoxidizing an aluminum substrate, said method comprising an operation of contacting the substrate with an aqueous liquid cleaning/deoxidizing composition according to claim 10 at a sufficient temperature for a sufficient time to be effective for cleaning/deoxidizing.

18. The method of claim 17 wherein the sufficient temperature is at least about 32° C., the sufficient time is from about 1 minute to about 15 minutes, and the aluminum substrate contains at least 65 atomic percent of pure aluminum.

19. An aqueous liquid composition of matter for cleaning/deoxidizing aluminum surfaces, said composition comprising water and the following dissolved components:

(A) a component of organic molecules of compounds that are liquid at 25° C. and are selected from the group consisting of: compounds made up of molecules that contain at least one hydroxyl oxygen atom and otherwise contain only carbon and hydrogen; and compounds made up of molecules that contain at least one ether oxygen atom and otherwise contain no atoms other than carbon, hydrogen, ether oxygen, hydroxyl oxygen, and halogen atoms;

(B) a component of alkalinizing agent, exclusive of any that contain fluoride anions;

(C) a compound of alkali stable surfactant molecules that are not part of any components (A) and (B) comprising a subcomponent (C.1) selected from the group consisting of monosodium salt of ISO-decyloxypropylaminodepropionic acid, organic esters of phosphoric acid, and salts of organic esters of phosphoric acid.

* * * * *

UNITED STATES PATENT AND TRADEMARK OFFICE

CERTIFICATE OF CORRECTION

PATENT NO. : 6,432,899 B1
DATED : August 13, 2002
INVENTOR(S) : Sjostrom

It is certified that error appears in the above-identified patent and that said Letters Patent is hereby corrected as shown below:

Column 12,
Line 56, after “hydrogen atoms”, insert -- , --.

Column 13,
Lines 22 and 23, after “phenol” and before “component”, insert -- , --.
Line 23, after “16.0”, delete “.”, and insert therefor -- , --.
Line 27, delete “further”.

Column 14,
Line 13, delete “lest”, and insert therefor -- least --.

Column 15,
Line 58, delete “or”.

Column 16,
Line 6, delete “lease”, and insert therefor -- least --.
Line 26, delete “last”, and insert therefor -- least --.

Signed and Sealed this

Sixth Day of May, 2003

JAMES E. ROGAN
*Director of the United States Patent and Trademark Office*